US005388514A

United States Patent [19]

Eltner

[11] Patent Number: 5,388,514

[45] Date of Patent: Feb. 14, 1995

[54] INKING UNIT FOR PRINTING MACHINES

[75] Inventor: Bruno Eltner, Heidelberg, Germany

[73] Assignee: Heidelberger Druckmaschinen Aktiengesellschaft, Heidelberg, Germany

[21] Appl. No.: 107,250

[22] Filed: Aug. 16, 1993

[30] Foreign Application Priority Data

Sep. 9, 1992 [DE] Germany ..... 4230090

[51] Int. Cl.[6] ..... B41F 31/06; B41F 31/32

[52] U.S. Cl. ..... 101/352; 101/483

[58] Field of Search ..... 101/350, 351, 352, 349, 101/148, 483, 485, 207–210

[56] References Cited

U.S. PATENT DOCUMENTS 4,387,647 6/1983 Fischer ..... 101/352
4,397,237 8/1983 Makosch ..... 101/352
4,625,642 12/1986 Despot et al. .
4,882,991 11/1989 Simeth ..... 101/352

FOREIGN PATENT DOCUMENTS 2106655 8/1972 Germany .
1451693 10/1976 United Kingdom .

*Primary Examiner*—J. Reed Fisher
*Attorney, Agent, or Firm*—Nils H. Ljungman & Associates

[57] ABSTRACT

An inking unit for printing machines comprises a plate cylinder and a plurality of plate inking rollers being continuously fed with ink by a plurality of inking rollers; seen in direction of rotation of the plate cylinder, the primary ink flow being supplied to the first group of plate inking rollers, and a secondary ink flow being supplied to a subsequent group of plate inking rollers, and comprising the possibility of improving the adjustment of the inking unit to the respective print job by forming two groups of plate inking rollers.

16 Claims, 3 Drawing Sheets

INKING UNIT FOR PRINTING MACHINES

BACKGROUND OF THE INVENTION

1. Field of the Invention

The present invention generally relates to an inking unit for printing machines, or printing presses. Such printing machines, or printing presses, typically comprise a plate cylinder and a plurality of plate inking rollers which are substantially continuously fed with ink by a plurality of inking rollers. A primary ink flow is supplied to a first group of plate inking rollers and a secondary ink flow is supplied to a subsequent, second group of plate inking rollers, as viewed in the direction of rotation of the plate cylinder.

2. Background Information

In a known inking unit comprising four plate inking rollers, the last two plate inking rollers, as viewed in the direction of rotation of the plate cylinder, generally serve to uniformly distribute the ink film and to transfer only a small amount of ink. Very good results can usually be obtained when using such an inking unit for top-grade print jobs having large areas to be printed. The German Laid Open Patent Application No. 21 06 655 discloses such an inking unit in which the amount of ink available on the last two plate inking rollers, as viewed in the direction of rotation of the plate cylinder, may be varied by an additional disengageable roller so that a varying amount of ink can be applied onto the printing plate via those two rollers. Such an inking unit is essentially designed to produce a top-grade print quality, meaning that, in practice, such an inking unit is generally too sophisticated for relatively ordinary print jobs with which, for example, ink plays only a subordinate role. In this respect, unnecessary costs may result.

OBJECT OF THE INVENTION

On the basis of the background set forth above, the objects of the invention are to improve the adaptability of an inking unit to a respective print job, to reduce the consumption of energy and to minimize the wear and tear of an inking unit.

SUMMARY OF THE INVENTION

According to the invention, the above objects are achieved in that the inking rollers feeding the subsequent, second group of plate inking rollers with a secondary ink flow are preferably mounted so as to be disengageable from the inking rollers feeding the first group of plate inking rollers with the primary ink flow such that the ink supply to the subsequent group of inking rollers is interrupted, and that the subsequent group of plate inking rollers is disengaged from the plate cylinder while the machine is running. This solution makes it possible to disengage part of the inking unit and to ink the printing plate only by means of, for example, two remaining plate inking rollers. Such a reduced number of plate inking rollers may tend to be sufficient with a number of straightforward print jobs so that, by disengaging the partial inking unit, drive energy is saved and wear and tear of the inking rollers is avoided.

A further advantage of the invention is the fact that such a "reduced" inking unit can be adjusted to the respective print job more quickly, thus producing less waste. It also reacts to inking changes more quickly and permits shorter times for correction work.

Furthermore, the development of heat, which normally tends to occur as a result of squeezing, or pressing, of various rollers, is reduced in the area of the inking rollers standing still, which is advantageous to printing. Thus, with each print job and each individual printing ink, the pressman can decide as to whether the highest possible inking quality is required or whether a respective print job may be effected with an inking unit having less inking rollers while, at the same time, still producing an optimum print result.

In an advantageous specimen embodiment of the invention, the inking unit is characterized in that, via an adjusting means, the first inking roller of the secondary ink flow is disengaged from the inking roller provided upstream thereof, that, as viewed in the direction of rotation of the plate cylinder, preferably the last two plate inking rollers, from among preferably four plate inking rollers, are disengaged, and that an intermediate roller provided between the second and the third plate inking rollers is lifted from the second plate inking roller. Thus, this specimen embodiment essentially requires only one additional adjusting means for the first plate inking roller of the secondary ink flow. The disengagement of the third and fourth plate inking roller may be effected via the ordinary adjusting means of the plate inking rollers; the third plate inking roller, in its disengaged position, lifting up an intermediate roller which may possibly be provided and disengages that intermediate roller from the second plate inking roller.

In other words, the intermediate roller is preferably configured such that the same will be passively disengaged from the second plate inking roller in response to the disengagement of the third and fourth plate inking rollers. According to this specimen embodiment of the invention, the objects of the invention are solved with little technical efforts and at low cost, an adjustment to the respective set-up of the inking unit being readily effected.

In summary, one aspect of the invention resides broadly in a printing press comprising: a frame; a plate cylinder being rotatably mounted on the frame; an ink reservoir for holding a supply of ink; an inking mechanism for transferring the ink between the ink reservoir and the plate cylinder during operation of the printing press; the inking mechanism comprising a plurality of inking rollers, at least one ink fountain roller and at least one transfer roller for transferring ink between the ink fountain roller and at least one of the plurality of inking rollers; a plurality of ink applicator rollers for being engaged with the plate cylinder and for applying ink to the plate cylinder; the plurality of ink applicator rollers comprising a first set of at least one ink applicator roller and a second set of at least one ink applicator roller; means for simultaneously providing a first stream of ink to the first set of at least one ink applicator roller and a second stream of ink to the second set of at least one ink applicator roller; and means for interrupting one of: the first stream of ink to the first set of at least one ink applicator roller; and the second stream of ink to the second set of at least one ink applicator roller; during operation of the printing press.

Another aspect of the invention resides broadly in a method of operating a printing press and printing a printed product, the method comprising the steps of: providing a frame; providing a plate cylinder and rotatably mounting the plate cylinder on the frame; providing an ink reservoir for holding a supply of ink; providing an inking mechanism for transferring the ink between the ink reservoir and the plate cylinder during operation of the printing press; the step of providing an inking mechanism further comprising the step of providing a plurality of inking rollers, at least one ink fountain roller and at least one transfer roller for transferring ink between the ink fountain roller and at least one of the plurality of inking rollers; providing a plurality of ink applicator rollers for being engaged with the plate cylinder and for applying ink to the plate cylinder; configuring the plurality of ink applicator rollers to comprise a first set of at least one ink applicator roller and a second set of at least one ink applicator roller; providing means for simultaneously providing a first stream of ink to the first set of at least one ink applicator roller and a second stream of ink to the second set of at least one ink applicator roller; and providing means for interrupting one of: the first stream of ink to the first set of at least one ink applicator roller; and the second stream of ink to the second set of at least one ink applicator roller; during operation of the printing press; the method further comprising the additional steps of: initiating operation of the printing press; transferring ink between the ink reservoir and the plate cylinder; the transferring step comprising the step of transferring the ink between the ink fountain roller and at least one of the plurality of inking rollers; engaging the plurality of inking rollers with the plate cylinder; applying ink to the plate cylinder by means of the plurality of inking rollers; simultaneously providing a first stream of ink to the first set of at least one ink applicator roller and a second stream of ink to the second set of at least one ink applicator roller; and interrupting one of: the first stream of ink to the first set of at least one ink applicator roller; and the second stream of ink to the second set of at least one ink applicator roller; during operation of the printing press.

BRIEF DESCRIPTION OF THE DRAWINGS

A specimen embodiment of the invention is schematically illustrated in the accompanying drawings, wherein.

DESCRIPTION OF THE PREFERRED EMBODIMENT

Figure 1:
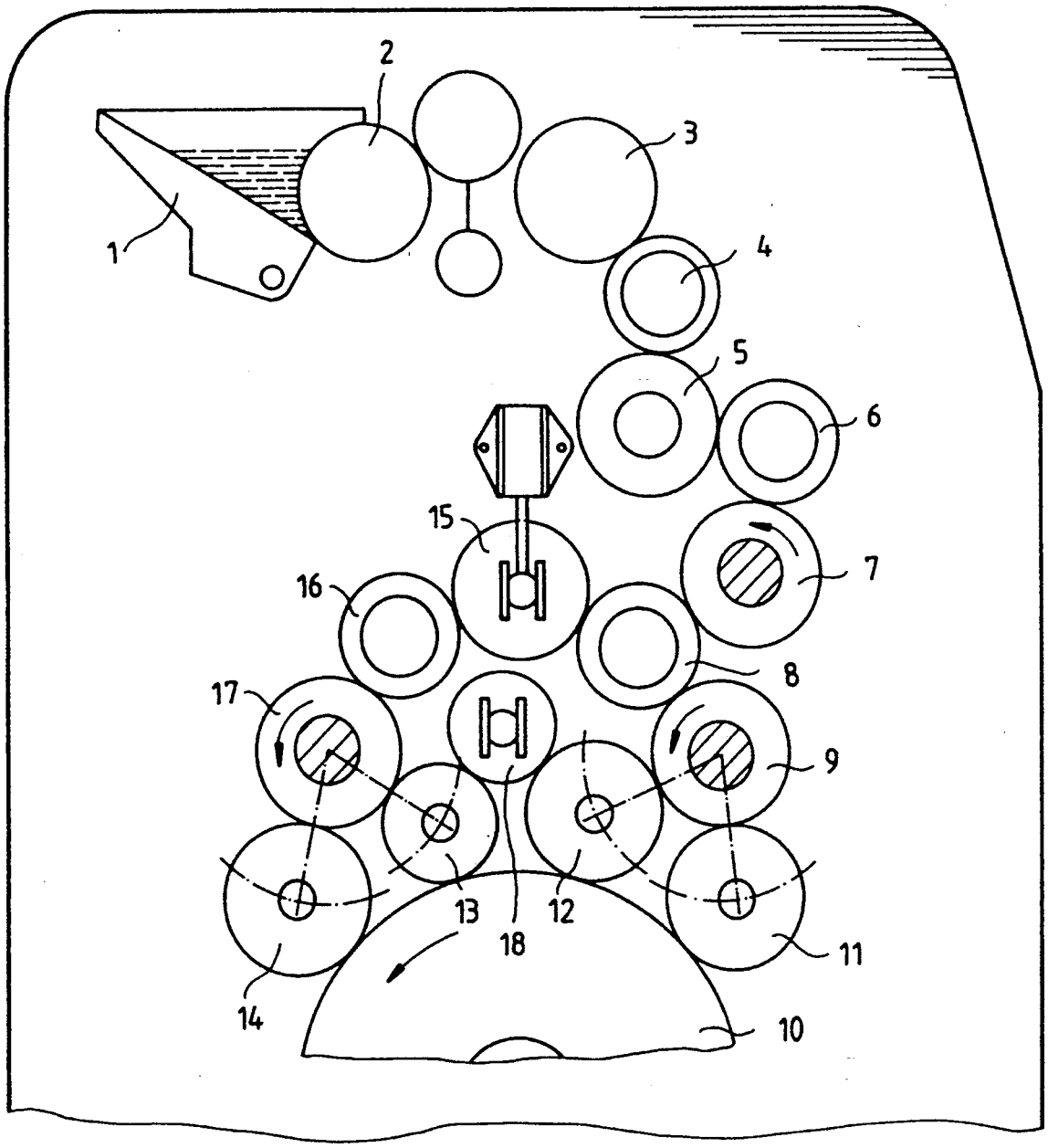
FIG. 1 is a schematic view of the inking unit showing the inking of the printing plate via four plate inking rollers.

In a known manner, the inking unit shown in FIG. 1 comprises an ink fountain 1 having a fountain roller 2 and ink rollers 3 through 9 supplying the primary ink flow to, as viewed in the direction of rotation of the plate cylinder 10, the first two plate inking rollers 11 and 12. The last two plate inking rollers 13 and 14 are supplied with a secondary ink flow by the inking rollers 15 through 17. In the specimen embodiment shown, an intermediate roller 18 is provided between the second plate inking roller 12 and the third plate inking roller 13. Thus, generally the ink is divided at the inking roller 8 into a primary and a secondary ink flow so that, due to the direction of rotation of the individual inking rollers, the primary ink flow is supplied to the first group of plate inking rollers 11 and 12.

Figure 2:
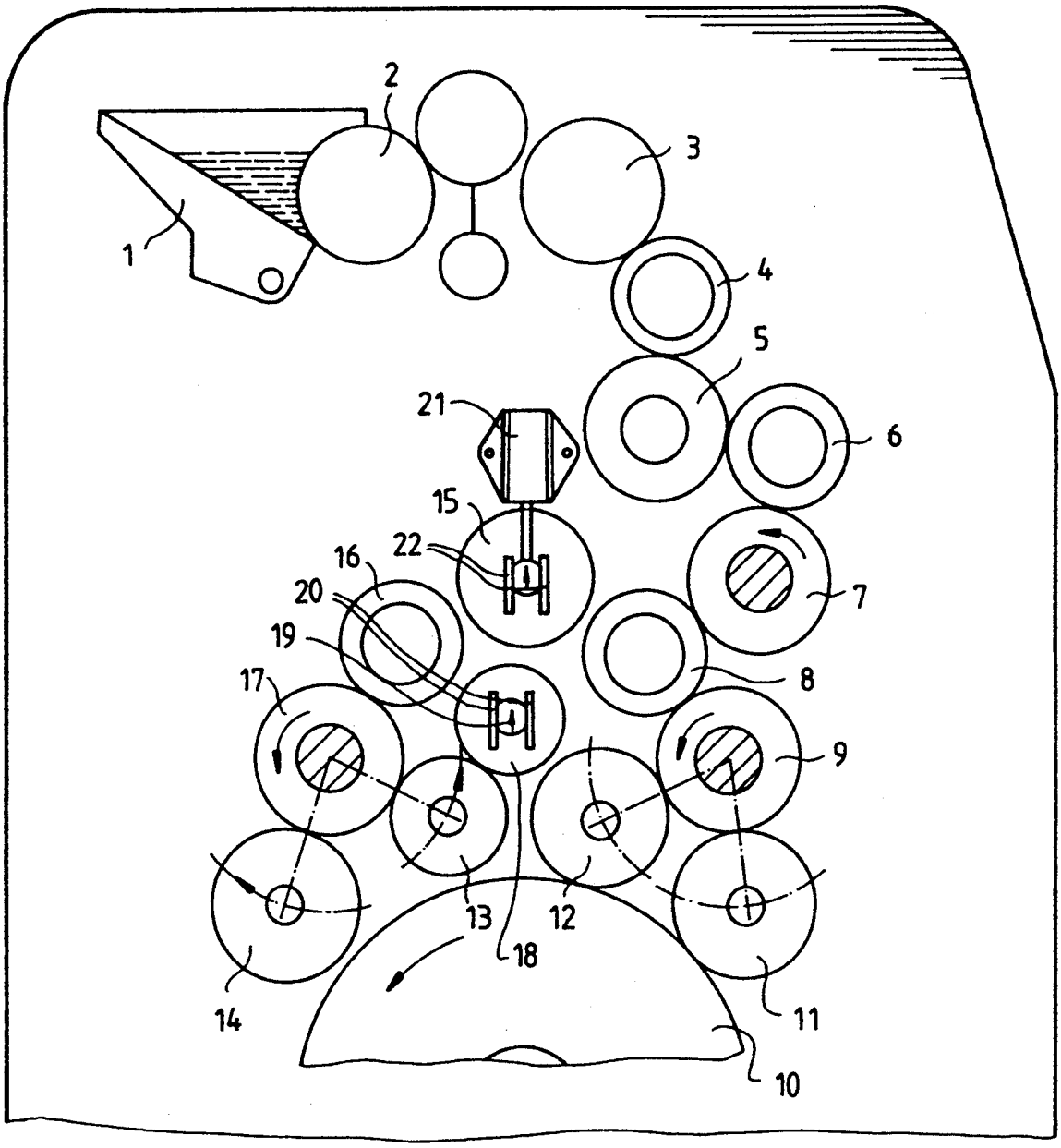
FIG. 2 is a schematic view of an inking unit showing the inking of the printing plate via the first two plate inking rollers.
Figure 2A:
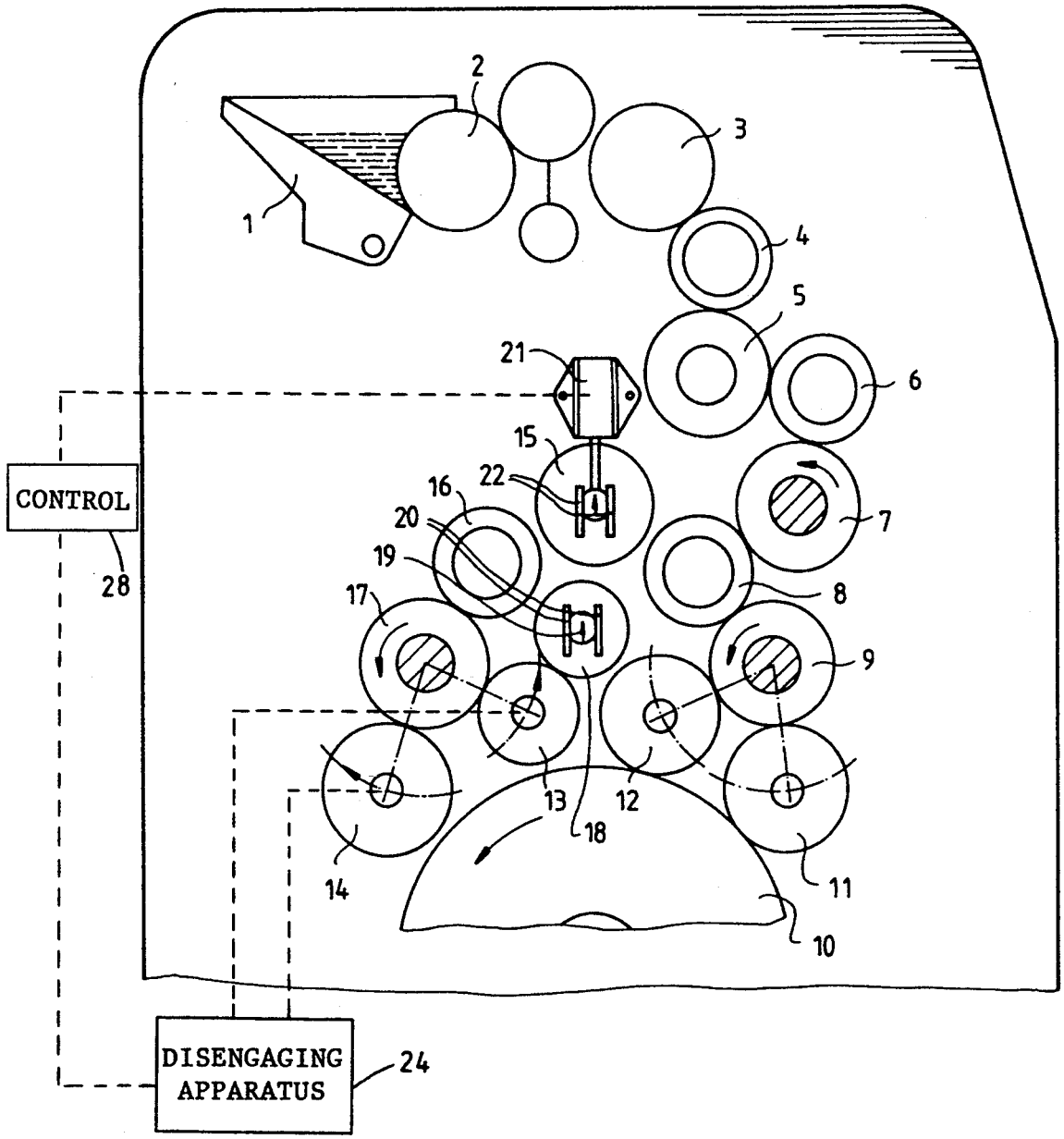
FIG. 2*a* is substantially the same view as FIG. 2 but illustrates additional components.

With reference to FIG. 2*a*, the printing press preferably includes a vibrator roller 23, which may be alternatively termed a "transfer roller".

In accordance with a preferred embodiment of the present invention, the rollers of the inking unit may preferably be arranged as follows:

- roller 3 is mounted to receive ink from fountain roller 2, via vibrator roller 23, and is engaged with roller 4;
- roller 4 is engaged with roller 5;
- roller 5 is engaged with roller 6;
- roller 6 is engaged with roller 7;
- roller 7 is engaged with roller 8;
- roller 8 is engaged with roller 9;
- roller 9 is engaged with plate inking rollers 11 and 12;
- roller 15 is selectively engageable and disengageable with both roller 8 and roller 16;
- roller 16 is engaged with roller 17;
- roller 17 is engaged with plate inking rollers 13 and 14; and
- intermediate roller 18 is engaged with plate inking roller 13 and is selectively engageable and disengageable with roller 12.

Thus, in accordance with the present invention, roller 8 preferably serves as a point of bifurcation for the primary and secondary ink flows, wherein the primary ink flow eventually reaches plate inking rollers 11 and 12 and the secondary ink flow eventually reaches plate inking rollers 13 and 14. In this manner, as shown in FIG. 1, the plate cylinder 10 can receive ink from both sets of plate inking rollers 11,12 and 13,14.

If, in accordance with a preferred embodiment of the present invention, the printing plate of the plate cylinder 10 is to be inked only via the first group of inking rollers 11 and 12, the two plate inking rollers 13 and 14 of the second group of plate inking rollers can, as shown in FIG. 2, preferably be lifted from the plate cylinder 10 via disengaging means provided for the plate inking rollers. A schematic representation of such disengaging means is indicated at 24 in FIG. 2*a*. In so doing, the intermediate roller 18 may preferably be mounted with its journals 19 in a sliding bearing 20 provided on both sides thereof so that the rolling contact between the plate inking roller 12 and the intermediate roller 18 is interrupted. Furthermore, the first inking roller 15 of the secondary ink flow, which may be alternatively termed a "bridge roller", is lifted in its bearing 22 via an adjusting means 21, which may be a servomotor, so that the outer cylindrical surface of the first inking roller 15 is not in contact with the outer cylindrical surface of the inking roller 8. Thus, the inking supply to the group of plate inking rollers 13 and 14 via the inking rollers 15 through 17 and the intermediate roller 18 can preferably be interrupted in the manner described immediately above. If desired, the drive of those rollers may also be switched off so that, given certain print jobs, said rollers may stand still after having been washed. This may be effected by disengaging the drive gear (not illustrated) of the inking roller 17, for example.

Thus, in accordance with a preferred embodiment of the present invention, as shown in FIGS. 2 and 2*a*, the inking unit can essentially be configured for selectively interrupting the secondary ink flow to the second set of plate inking rollers 13,14. In this regard, the first inking roller of the secondary ink flow, designated as roller 15, is preferably slidably mounted in a bearing 22 and is preferably slidably displaceable by means of an adjusting means 21. Such an adjusting means may include, for example, a servomotor or another suitable actuator arrangement known to those of ordinary skill in the art. Thus, to interrupt the secondary ink flow, roller 15 can preferably be slidably displaced away from roller 8 so that roller 8 will subsequently transfer ink only to roller 9. Additionally, plate inking rollers 13 and 14 may preferably be disengaged from plate cylinder 10, by means of the disengaging apparatus 24 illustrated in FIG. 2*a*. Also, if the inking unit includes an intermediate roller 18 positioned between, as viewed in the direction of rotation of the plate cylinder, the last plate inking roller 12 of the first set of plate inking rollers 11,12 and the first plate inking roller 13 of the second set of plate inking rollers 13,14, such an intermediate roller 18 can preferably have its journals 19 slidably mounted in a bearing 20. As such, intermediate roller 18 can preferably be configured such that, upon disengagement of plate inking roller 13 from plate cylinder 10, intermediate roller 18 will essentially be pushed upward in its bearing 20 by plate inking roller 13 and will become disengaged from plate inking roller 12. Thus, such an action can preferably ensure that the secondary ink flow is completely prevented from reaching plate cylinder 10 and that, if desired, the rollers associated with the secondary ink flow can remain non-driven during an operation of the printing press which involves only the application of the primary ink flow to the plate cylinder 10.

It should be understood that, in accordance with the present invention, it is conceivable that the inking unit and associated rollers could be configured to also, optionally, interrupt the primary ink flow to the plate cylinder, instead of the secondary ink flow. For example, the first set of plate inking rollers 11,12 could be selectively disengageable from the plate cylinder 10 in a manner similar to the second set of plate inking rollers 13,14. Additionally, it should be understood that the present invention is essentially applicable with other numbers of plate inking rollers, such as two, three, five, or even six or more plate inking rollers, providing that at least one plate inking roller is configured to receive a primary ink flow and that at least one other plate inking roller is configured to receive a secondary ink flow.

A printing press frame, on which the rollers and cylinders described above may be mounted, is indicated at 26 in FIG. 2*a*.

Also, schematically indicated at 28 in FIG. 2*a* is a control arrangement which may preferably be employed to control adjusting means 21 and disengaging apparatus 24. Control arrangement 28 may preferably be configured to control adjusting means 21 and disengaging apparatus either separately or in a coordinated manner.

One feature of the invention resides broadly in the inking unit for printing machines comprising a plate cylinder and a plurality of plate inking rollers being continuously fed with ink by a plurality of inking rollers; seen in direction of rotation of the plate cylinder, the primary ink flow being supplied to the first group of plate inking rollers and a secondary ink flow being supplied to a subsequent group of plate inking rollers, characterized in that the inking rollers 15 through 17 supplying the secondary ink flow to the subsequent group of plate inking rollers 13, 14 are mounted so as to be disengaged from the inking rollers 3 through 9 supplying the primary ink flow to the first group of plate inking rollers 11, 12 such that the ink supply to the subsequent group of inking rollers 13, 14 is interrupted, and that the subsequent group of plate inking rollers 13, 14 is disengaged from the plate cylinder while the machine is running.

Another feature of the invention resides broadly in the inking unit, characterized in that, via an adjusting means 21, the first inking roller 15 of the secondary ink flow is disengaged from the inking roller 8 provided upstream thereof, that, seen in direction of rotation of the plate cylinder 10, the last two plate inking rollers 13, 14 - from among four plate inking rollers 11 through 14 - are disengaged, and that the intermediate roller 18 provided between the second and the third plate inking roller 12, 13 is lifted from the second plate inking roller 12.

An example of an arrangement for disengaging, or lifting, ink applicator rollers from a plate cylinder, including a control arrangement, may be found in U.S. Pat. No. 3,809,983 to Garber, entitled "Variable Repeat-Length Web Press".

Examples of general components for printing presses, which may be utilized in accordance with the embodiments of the present invention, may be found in the following U.S. Pat. Nos. 5,010,820, which issued to Löffler on Apr. 30, 1991; and 5,081,926, which issued to Rodi on Jan. 21, 1992.

Examples of arrangements for disengaging, or lifting, ink applicator rollers from a plate cylinder, including control arrangements, may be found in the U.S. Patents listed immediately above and also in U.S. Patent No. 3,809,983 to Garber, entitled "Variable Repeat-Length Web Press".

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

LIST OF REFERENCE NUMERALS

1 ink fountain
2 fountain roller
3 inking roller
4 inking roller
5 inking roller
6 inking roller
7 inking roller
8 inking roller
9 inking roller
10 plate cylinder
11 plate inking roller
12 plate inking roller
13 plate inking roller
14 plate inking roller

15 inking roller
16 inking roller
17 inking roller
18 intermediate roller
19 journal
20 sliding bearing
21 adjusting means
22 bearing
23 vibrator roller
24 disengaging apparatus
26 printing press frame
28 control arrangement

What is claimed is:

1. Method of operating a printing press and printing a printed product, said method comprising the steps of:

providing at least one printing unit;

said step of providing at least one printing unit comprising the steps of:

providing a frame;

providing a plate cylinder and rotatably mounting said plate cylinder on said frame;

providing an ink reservoir for holding a supply of ink;

providing an inking mechanism for transferring the ink between said ink reservoir and said plate cylinder during operation of said printing press;

said step of providing an inking mechanism further comprising the step of providing a plurality of inking rollers, at least one ink fountain roller and at least one transfer roller for transferring ink between said ink fountain roller and at least one of said plurality of inking rollers;

providing a first set of at least one ink applicator roller and a second set of at least one ink applicator roller;

the first set of at least one ink applicator roller and the second set of at least one ink applicator roller constituting the only means in the corresponding printing unit for directly contacting and transferring ink to the plate cylinder;

providing means for engaging the first set of at least one ink applicator roller with the plate cylinder;

providing means for engaging the second set of at least one ink applicator roller with the plate cylinder;

providing means for simultaneously providing a first stream of ink to said first set of at least one ink applicator roller and a second stream of ink to said second set of at least one ink applicator roller; and providing means for interrupting the second stream of ink to said second set of at least one ink applicator roller, while maintaining flow of the first stream of ink to the first set of at least one ink applicator roller, during a printing operation of said printing press;

said method further comprising the additional steps of:

initiating a printing operation of said printing press;

transferring ink between said ink reservoir and said plate cylinder:

said transferring step comprising the step of transferring the ink between said ink fountain roller and at least one of said plurality of inking rollers;

engaging said first set of at least one ink applicator roller with said plate cylinder;

engaging said second set of at least one ink applicator roller with said plate cylinder;

applying ink to said plate cylinder by means of said first set of at least one ink applicator roller and said second set of at least one ink applicator roller;

simultaneously providing a first stream of ink to said first set of at least one ink applicator roller and a second stream of ink to said second set of at least one ink applicator roller; and interrupting the second stream of ink to said second set of at least one ink applicator roller, while maintaining flow of the first stream of ink to said first set of at least one ink applicator roller, during the printing operation of said printing press;

said method further comprising the additional steps of:

configuring said plate cylinder such that a circumference is defined thereabout and said plate cylinder has a direction of rotation, the circumference of said plate cylinder having a minor portion and a major portion, the minor portion extending about the circumference of said plate cylinder over a first angle, the major portion extending about the circumference of said plate cylinder over a second angle, the second angle being greater than the first angle, the sum of the first angle and the second angle being 360°; and positioning said first set of at least one ink applicator roller before said second set of at least one ink applicator roller, in the direction of rotation of said plate cylinder, such that, during operation of said printing press, a point on the plate cylinder is displaced:

firstly in time, past said first set of at least one ink applicator roller;

thence, secondly in time, through the minor portion of the circumference of said plate cylinder;

thence, thirdly in time, past said second set of at least one ink applicator roller; and thence, fourthly in time, through the major portion of the circumference of said plate cylinder.

2. The method according to claim 1, wherein:

said means for engaging said second set of at least one ink applicator roller comprises means for removably disengaging said second set of at least one ink applicator roller from said plate cylinder during the printing operation of said printing press and simultaneously with said step of interrupting the second stream of ink to said second set of at least one ink applicator roller;

said method further comprises the step of removably disengaging said second set of at least one ink applicator roller from said plate cylinder during operation of said printing press and simultaneously with said step of interrupting the second stream of ink to said second set of at least one ink applicator roller.

3. The method according to claim 2, further comprising the steps of:

configuring said plurality of inking rollers to comprise a first set of at least one inking roller and a second set of at least one inking roller;

configuring said first set of at least one inking roller to comprise means for providing ink to said first set of at least one ink applicator roller;

configuring said second set of at least one inking roller to comprise means for providing ink to said second set of at least one ink applicator roller;

configuring said means for interrupting the second stream of ink to said second set of at least one ink applicator roller to comprise means for interrupting the second stream of ink to said second set of at least one inking roller;

said method further comprising the additional steps of:

providing ink to said first set of at least one ink applicator roller from said first set of at least one inking roller;

providing ink to said second set of at least one ink applicator roller from said second set of at least one inking roller; and said step of interrupting the second stream of ink to said second set of at least one ink applicator roller comprising the step of interrupting the second stream of ink to said second set of at least one inking roller.

4. The method according to claim 3, further comprising the steps of:

configuring said means for interrupting the second stream of ink to said second set of at least one inking roller to comprise:

bridge roller means for being engaged with:

at least one inking roller of said first set of at least one inking roller; and at least one inking roller of said second set of at least one inking roller;

providing means for selectively positioning said bridge roller means between a first position, wherein said bridge roller means is in engagement with at least one of said:

at least one inking roller of said first set of at least one inking roller; and at least one inking roller of said second set of at least one inking roller; and a second position, wherein said bridge roller means is disengaged from said at least one of said:

at least one inking roller of said first set of at least one inking roller; and at least one inking roller of said second set of at least one inking roller;

wherein the second stream of ink is interrupted when said bridge roller means is in said second position;

said method further comprising the additional steps of: engaging said bridge roller means with:

at least one inking roller of said first set of at least one inking roller; and at least one inking roller of said second set of at least one inking roller;

to provide the first stream of ink to said first set of at least one inking roller and the second stream of ink to said second set of at least one inking roller; and disengaging said bridge roller means from said:

at least one inking roller of said first set of at least one inking roller; and at least one inking roller of said second set of at least one inking roller;

to interrupt the second stream of ink to said second set of at least one inking roller.

5. The method according to claim 4, wherein said step of engaging said bridge roller means with:

at least one inking roller of said first set of at least one inking roller; and at least one inking roller of said second set of at least one inking roller;

comprises the step of engaging said bridge roller means with only one inking roller of said first set of at least one inking roller.

6. The method according to claim 5, wherein said step of engaging said bridge roller means with:

at least one inking roller of said first set of at least one inking roller; and at least one inking roller of said second set of at least one inking roller;

comprises the step of engaging said bridge roller means with only one inking roller of said second set of at least one inking roller.

7. The method according to claim 6, wherein said step of disengaging said bridge roller means from said:

at least one inking roller of said first set of at least one inking roller; and at least one inking roller of said second set of at least one inking roller;

comprises the step of disengaging said bridge roller means from said one inking roller of said first set of said at least one inking roller.

8. The method according to claim 7, further comprising the steps of:

said step of disengaging said bridge roller means from said:

at least one inking roller of said first set of at least one inking roller; and at least one inking roller of said second set of at least one inking roller;

comprises the step of disengaging said bridge roller means from said one inking roller of said second set of said at least one inking roller;

providing intermediate roller means for being engaged with one of said first set of at least one ink applicator roller and one of said second set of at least one ink applicator roller;

providing means for disengaging said intermediate roller means from said one of said first set of at least one ink applicator roller in response to the disengagement of said second set of at least one applicator roller from said plate cylinder;

configuring said means for disengaging said intermediate roller means from said one of said first set of at least on ink applicator roller to comprise:

journal means extending from said intermediate roller means;

slide bearing means being disposed on said printing frame;

said journal means for being slidably mounted in said slide bearing means;

configuring said one of said second set of at least one applicator roller for slidably displacing said intermediate roller means in a direction away from said one of said first set of at least one ink applicator roller to disengage said intermediate roller means from said one of said first set of at least one ink applicator roller simultaneously with the disengagement of said second set of at least one ink applicator roller from said plate cylinder;

configuring said first set of at least one ink applicator roller to comprise two ink applicator rollers;

configuring said second set of at least one ink applicator roller to comprise two ink applicator rollers;

configuring said plurality of inking rollers to comprise a third set of inking rollers extending from said transfer roller and said one of said first set of at least one inking roller;

configuring said third set of inking rollers to comprise:

a first inking roller for being engaged with said transfer roller;

a second inking roller being engaged with said first inking roller;

a third inking roller being engaged with said second inking roller;

a fourth inking roller being engaged with said third inking roller;

a fifth inking roller being engaged with said fourth inking roller and with said one of said first set of at least one inking roller;

configuring said one of said first set of at least one inking roller to be a sixth inking roller;

configuring said first set of at least one inking roller to comprise:

said sixth inking roller;

a seventh inking roller being engaged with said sixth inking roller and with a first ink applicator roller of said first set of at least one applicator roller and a second ink applicator roller of said first set of at least one ink applicator roller;

said second set of at least one inking roller comprising:

said bridge roller means;

an eighth inking roller for being engaged with said bridge roller means, said eighth inking roller being said one of said second set of at least one inking roller;

a ninth inking roller being engaged with said eighth inking roller; and a tenth inking roller being engaged with said eighth inking roller and with a first ink applicator roller of said second set of at least one applicator roller and a second ink applicator roller of said second set of at least one ink applicator roller;

engaging said intermediate roller means with said second ink applicator roller of said first set of at least one ink applicator roller and said first ink applicator roller of said second set of at least one ink applicator roller;

configuring said means for selectively positioning said bridge roller means to comprise:

a slide bearing for slidably mounting said bridge roller means; and means for slidably displacing said bridge roller means within said slide bearing;

disengaging said intermediate roller means from said one of said first set of at least one ink applicator roller in response to the disengagement of said second set of at least one applicator roller from said plate cylinder;

slidably displacing said intermediate roller means, with said one of said second set of at least one ink applicator roller, in a direction away from said one of said first set of at least one ink applicator roller to disengage said intermediate roller means from said one of said first set of at least one ink applicator roller simultaneously with the disengagement of said second set of at least one ink applicator roller from said plate cylinder; and said step of selectively positioning said bridge roller means comprising the step of slidably displacing said bridge roller means within said slide bearing.

9. A printing press comprising:

at least one printing unit;

said at least one printing unit comprising:

a frame;

a plate cylinder being rotatably mounted on said frame;

an ink reservoir for holding a supply of ink;

an inking mechanism for transferring the ink between said ink reservoir and said plate cylinder during operation of said printing press;

said inking mechanism comprising a plurality of inking rollers, at least one ink fountain roller and at least one transfer roller for transferring ink between said ink fountain roller and at least one of said plurality of inking rollers;

a first set of at least one ink applicator roller and a second set of at least one ink applicator roller;

said first set of at least one ink applicator roller and said second set of at least one ink applicator roller constituting the only means in the corresponding printing unit for transferring ink to said plate cylinder;

means for engaging said first set of at least one ink applicator roller with said plate cylinder;

means for engaging said second set of at least one ink applicator roller with said plate cylinder;

means for simultaneously providing a first stream of ink to said first set of at least one ink applicator roller and a second stream of ink to said second set of at least one ink applicator roller;

means for interrupting the second stream of ink to said second set of at least one ink applicator roller, while maintaining flow of the first stream of ink to the first set of at least one inking roller, during a printing operation of said printing press;

said plate cylinder defining a circumference thereabout and having a direction of rotation, the circumference of said plate cylinder having a minor portion and a major portion, the minor portion extending about the circumference of said plate cylinder over a first angle, the major portion extending about the circumference of said plate cylinder over a second angle, the second angle being greater than the first angle, the sum of the first angle and the second angle being 360°;

said first set of at least one ink applicator roller being positioned before said second set of at least on ink applicator roller, as viewed in the direction of rotation of said plate cylinder, such that, during operation of said printing press, a point on the plate cylinder is displaced:

firstly in time, past said first set of at least one ink applicator roller;

thence, secondly in time, through the minor portion of the circumference of said plate cylinder;

thence, thirdly in time, past said second set of at least one ink applicator roller; and thence, fourthly in time, through the major portion of the circumference of said plate cylinder.

10. The printing press according to claim 9, wherein said means for engaging said second set of at least one ink applicator roller comprises means for removably disengaging said second set of at least one ink applicator roller from said plate cylinder during the printing operation of said printing press and simultaneously with the interrupting of the second stream of ink to the second set of at least one ink applicator roller.

11. The printing press according to claim 10, wherein:

said plurality of inking rollers comprises a first set of at least one inking roller and a second set of at least one inking roller;

said first set of at least one inking roller comprising means for providing ink to said first set of at least one ink applicator roller;

said second set of at least one inking roller comprising means for providing ink to said second set of at least one ink applicator roller;

said means for interrupting the second stream of ink to said second set of at least one ink applicator roller comprising means for interrupting the second stream of ink to said second set of at least one inking roller.

12. The printing press according to claim 11, wherein:

said means for interrupting the second stream of ink to said second set of at least one inking roller comprises:

bridge roller means for being engaged with:

at least one inking roller of said first set of at least one inking roller; and at least one inking roller of said second set of at least one inking roller;

means for selectively positioning said bridge roller means between a first position, wherein said bridge roller means is in engagement with at least one of said:

at least one inking roller of said first set of at least one inking roller; and at least one inking roller of said second set of at least one inking roller;

and a second position, wherein said bridge roller means is disengaged from said at least one of said:

at least one inking roller of said first set of at least one inking roller; and at least one inking roller of said second set of at least one inking roller;

wherein the second stream of ink is interrupted when said bridge roller means is in said second position.

13. The printing press according to claim 12, wherein said bridge roller means is engaged with only one inking roller of said first set of at least one inking roller when said bridge roller means is in said first position.

14. The printing press according to claim 13, wherein said bridge roller means is engaged with only one inking roller of said second set of at least one inking roller when said bridge roller means is in said first position.

15. The printing press according to claim 14, wherein said bridge roller means is disengaged from said one inking roller of said first set of said at least one inking roller when said bridge roller means is in said second position.

16. The printing press according to claim 15, further comprising:

said bridge roller means being disengaged from said one inking roller of said second set of said at least one inking roller when said bridge roller means is in said second position.

intermediate roller means for being engaged with one of said first set of at least one ink applicator roller and one of said second set of at least one ink applicator roller;

means for disengaging said intermediate roller means from said one of said first set of at least one ink applicator roller in response to the disengagement of said second set of at least one applicator roller from said plate cylinder;

said means for disengaging said intermediate roller means from said one of said first set of at least one ink applicator roller comprising:

journal means extending from said intermediate roller means;

slide bearing means being disposed on said printing frame;

said journal means for being slidably mounted in said slide bearing means;

said one of said second set of at least one applicator roller being configured for slidably displacing said intermediate roller means in a direction away from said one of said first set of at least one ink applicator roller to disengage said intermediate roller means from said one of said first set of at least one ink applicator roller simultaneously with the disengagement of said second set of at least one ink applicator roller from said plate cylinder;

said first set of at least one ink applicator roller comprising two ink applicator rollers;

said second set of at least one ink applicator roller comprising two ink applicator rollers;

said plurality of inking rollers comprising a third set of inking rollers extending from said transfer roller and said one of said first set of at least one inking roller;

said third set of inking rollers comprising:

a first inking roller for being engaged with said transfer roller;

a second inking roller being engaged with said first inking roller;

a third inking roller being engaged with said second inking roller;

a fourth inking roller being engaged with said third inking roller;

a fifth inking roller being engaged with said fourth inking roller and with said one of said first set of at least one inking roller;

said one of said first set of at least one inking roller being a sixth inking roller;

said first set of at least one inking roller comprising:

said sixth inking roller;

a seventh inking roller being engaged with said sixth inking roller and with a first ink applicator roller of said first set of at least one applicator roller and a second ink applicator roller of said first set of at least one ink applicator roller;

said second set of at least one inking roller comprising:

said bridge roller means;

an eighth inking roller for being engaged with said bridge roller means, said eighth inking roller being said one of said second set of at least one inking roller;

a ninth inking roller being engaged with said eighth inking roller; and a tenth inking roller being engaged with said eighth inking roller and with a first ink applicator roller of said second set of at least one applicator roller and a second ink applicator roller of said second set of at least one ink applicator roller;

said intermediate roller means for being engaged with said second ink applicator roller of said first set of at least one ink applicator roller and said first ink applicator roller of said second set of at least one ink applicator roller; and said means for selectively positioning said bridge roller means comprising:

a slide bearing for slidably mounting said bridge roller means; and means for slidably displacing said bridge roller means within said slide bearing.

* * * * *